United States Patent [19]

Boross et al.

[11] Patent Number: 4,993,332

[45] Date of Patent: Feb. 19, 1991

[54] HYBRID FLUIDIZED BED AND PULVERIZED COAL COMBUSTION SYSTEM AND A PROCESS UTILIZING SAID SYSTEM

[75] Inventors: László Boross, Budapest; Sandor Kovacs, Tatabanya; Karoly Remenyi, Budapest; Pal Resch, Budapest; László Vörös, Budapest; Ferenc Horvath, Budapest; Tibor Gerlai, Budapest, all of Hungary

[73] Assignees: Villamosenergiapari Kutato Intezet, Budapest; Tatabanyai Hoeromu Vallalat, Tatabanya, both of Hungary

[21] Appl. No.: 416,312

[22] PCT Filed: Oct. 27, 1988

[86] PCT No.: PCT/HU88/00070

§ 371 Date: Sep. 13, 1989

§ 102(e) Date: Sep. 13, 1989

[87] PCT Pub. No.: WO89/04940

PCT Pub. Date: Jun. 1, 1989

[30] Foreign Application Priority Data

Nov. 17, 1987 [HU] Hungary ..... 4645/86

[51] Int. Cl.[5] ..... F23D 1/00

[52] U.S. Cl. ..... 110/347; 110/204; 110/232; 110/245; 110/263

[58] Field of Search ..... 110/347, 263, 232, 245, 110/204, 205; 122/4 D

[56] References Cited

U.S. PATENT DOCUMENTS

| | | | |
|---|---|---|---|
| 4,267,801 | 5/1981 | Robinson | 122/4 D |
| 4,270,468 | 6/1981 | Robinson | 110/245 |
| 4,397,248 | 8/1983 | Metha et al. | 110/232 X |
| 4,421,036 | 12/1983 | Brannstrum et al. | 110/186 |
| 4,438,709 | 3/1984 | Borio et al. | 110/347 |
| 4,528,918 | 7/1985 | Sato et al. | 110/347 |

FOREIGN PATENT DOCUMENTS 2105606 3/1983 United Kingdom .

*Primary Examiner*—Edward G. Favors
*Attorney, Agent, or Firm*—Herbert Dubno

[57] ABSTRACT

A hybrid combustion system is provided combining advantages of a fluidized bed combustion portion and a pulverized coal combustion portion. The former portion includes a fluidized bed chamber, a coal mill without an air separator, a recycling duct connected to the coal mill, a coal supply duct, and a spray feeder. The fluidized coal combustion portion includes a pulverizing coal mill with air separator, a blowing duct for blowing ground coal, at least one pulverized coal burner and an air recycling duct for recycling combustion air. Fluidized bed combustion takes place in a lower part of the system and pulverized coal combustion takes place above the fluidized bed combustion. Each of the portions may be independently operated of the other. A main combustion chamber is common to both the fluidized bed portion and the pulverized coal portion. A related process is also described.

9 Claims, 5 Drawing Sheets

HYBRID FLUIDIZED BED AND PULVERIZED COAL COMBUSTION SYSTEM AND A PROCESS UTILIZING SAID SYSTEM

FIELD OF THE INVENTION

The invention concerns a hybrid fluidized bed and pulverized coal combustion system which as a consequence of the combination of fluidized bed combustion and the conventional pulverized coal combustion has at least one coal grinding plant(coal mill), at least one pulverized coal burner, an air distributor required for realizing fluidized bed combustion, a device for blowing in secondary air, a slag removal device as well as an ignition device. Furthermore the invention concerns a process for converting the already available pulverized coal boilers (furnaces) to the hybrid fluidization bed and pulverized coal combustion system.

BACKGROUND OF THE INVENTION

In the known solutions of pulverized coal firing the pulverized coal ground to the required fineness in a pulverized coal preparation system and dried therein is fed to a pulverized coal burner where the pulverized coal is mixed with the combustion air. The mixture ignites in the combustion chamber and burns at a high temperature. A part of the released heat quantity is radiated at the cooled wall of the furnace chamber while the remaining part will be utilized at the other surfaces of the boiler (super-heater, feed water preheater, air heater).

This known mode of combustion and the plant serving for its realization are disadvantageous from several points of view. It is disadvantageous that in order to obtain practically complete combustion of the combustible part of the pulverized coal, the coal must be ground to the required fineness. Grinding involves a significant expenditure of energy and costs. Even despite this measure, one must reckon with ignition problems and with extinction of the fire when the quality of the coal is poorer than planned. A further disadvantage is that the still tolerable partial load (without auxiliary combustion with gas or oil) amounts to approximately 60 to 70% of the nominal load. It is also disadvantageous that due to the high temperature prevailing in the furnace chamber, the emission of environmentally harmful materials, particularly of $NO_x$, has an extremely high value and the basic additive for use for binding the $SO_2$ is not sufficiently effective so that a supplementary, expensive flue gas purification must be carried out.

In the per se also known solutions of fluidized bed combustion, the unground coal introduced e.g. via an air distributor assuring uniform distribution is combusted completely or partially with the combustion air flowing through the air distributor at a relatively low temperature of between 750° and 950° C.

In this case, the grinding process producing the pulverized coal is obviated. Thereby the costs of grinding are saved, the glowing fluidized bed of high mass assures an insensitivity to changes in the quality of the coal and at the same time the combustion temperature, being restricted to the temperature range of between 750° and 950° C., also restricts environmental pollution caused by $NO_x$ and $SO_2$.

The known mode of using fluidized bed combustion nevertheless brings also certain disadvantages with it.

In a variant of fluidized bed combustion, a full combustion of the coal is realized in the fluidized bed and the overwhelming part of the released heat is abstracted by way of cooling surfaces immersed into the fluidized bed. In another version the coal is only partially combusted in the fluidized bed whereafter the gases leaving the fluidized bed are combusted with air passed over the fluidized bed. In this solution the cooling surfaces immersed into the fluidized bed are mostly dispensed with.

In both cases the flow velocity of the air supplied to maintain the fluidized state and also to promote the combustion process is relatively low (it is, in general, below a velocity of 4 m/s). Consequently it is necessary to overdimension the cross-section of the fluidized bed transversely of the direction of air flow in relation to the dimensions of the pulverized coal combustion systems wherein the velocity of the pulverized coal supply does not in general exceed the value of 15 m/s; in other words, for a unit surface area of the air distributor only a relatively small amount of heat can be released which again leads to a significant increase of dimensions.

Hybrid combustion systems combining these known systems have been developed at least partially to obviate the drawbacks and disadvantages of fluidized bed combustion and the conventional pulverized coal combustion. The known apparatuses for realizing this hybrid combustion nevertheless do not enable the frequently necessary strong output control to be carried out, and in addition the sensitivity to the quality of the coal is the same as before, both combustion systems being served by the same coal grinding and delivery system even when it contains separate units. A typical example of such a hybrid combustion system may be learned from Hungarian Patent Specification No. 185 694.

In this apparatus the relatively homogeneous, grit-like coal, pre-dried in the coal mill, separated in an air separator connected downstream of the coal mill and ground to a predetermined, e.g. 1–3 mm particle size, is not recycled to the coal mill for further comminution; instead, it is fed with the aid of a mechanical transport device to a fluidized bed formed at the bottom of the furnace chamber of the boiler, while the finely ground pulverized coal passing the air separator is fed from the air separator via a pulverized coal duct into a pulverized coal burner debouching into the combustion chamber. In this solution the coal mill and the air separator used are such as to permit the whole coal quantity required for both systems to pass therethrough.

A further disadvantage of this solution consists in that the portion of the coal combusted in the fluidized bed and the portion of the coal combusted in the pulverized coal burner are fixed and the operation of the two systems cannot be separated from each other.

The aim of the invention is the combination of the advantages of the known solutions with the simultaneous obviation of their drawbacks.

SUMMARY OF THE INVENTION

By using the plant according to the invention the aim set may be achieved in that in the hybrid combustion realizing the partial conventional pulverized coal combustion and partial fluidized bed combustion the amount of coal combustible in the combustion chamber may be a multiple of that amount of coal which is kept in a fluidized state by the air distributor and burnt there.

In the case of poorer quality coal no problems arise either with the ignition nor with any unforeseen extinction of the fire, because these problems are eliminated by the stable fluidized bed combustion via the air distributor. The plant with hybrid combustion is capable even without additional oil or gas combustion to function with a partial load of 30 to 40%. The temperature in the combustion furnace falls between the temperature values usual in pulverized coal combustion and fluidized bed combustion so that in comparison with pulverized coal combustion a more environment-friendly solution may be achieved. Care must be taken to ensure that the flame of the pulverized coal burner should never come into contact with the oppositely lying wall because that could possibly lead to slag formation and to a slag fall; for these reasons it is expedient to select a high fluidization air velocity exceeding the value of 4 m/s and to 'dilute' the pulverized coal burner flame, and at the same time the excess air of the fluidized bed combustion operating with a large air excess may be consumed advantageously in the pulverized coal burner with the pulverized coal blown in, expediently, with a velocity of 15–25 m/s, whereby the secondary air of the latter is supplied in a reduced quantity and at a reduced velocity or is fully omitted.

Advantageously, the homogeneous temperature distribution in the combustion chamber is combined with known elements or other inventions promoting an internal gas and coal dust circulation.

The usual solutions may be utilized with regard to the addition of basic additives for reducing the environment-damaging $SO_2$ emissions.

The quality and provenance of the coal supplied to the part serving for pulverized coal combustion may be different from that supplied to the fluidized bed combustion, whereby the ability of the combustion plant to match the instantaneous conditions may be increased.

In the case of lower loads the fluidization bed combustion portion is operated predominantly. The combustion capacity of the pulverized coal combustion part is in general to be selected to be higher than the fluidization bed combustion part. Correspondingly, the width of the fluidized bed is mostly smaller than the full width of the combustion chamber.

The essential advantage of the hybrid combustion system according to the invention shows itself in that the part of the apparatus serving for fluidized bed combustion may also be operated independently, i.e. without operating the part lying above the fluidized part and serving for pulverized coal combustion and vice versa, the plant part for pulverized coal combustion may also be operated independently while the fluidized bed combustion is fully shut down. The possibility of this mutually independent operation increases the flexibility of the whole plant whereby it is capable of matching the desired instantaneous output and the variable quality of the fuel.

BRIEF DESCRIPTION OF THE DRAWING

The combustion system according to the invention is described in greater detail by means of a preferred embodiment with reference to the attached drawings, wherein.

DETAILED DESCRIPTION

Figure 1:
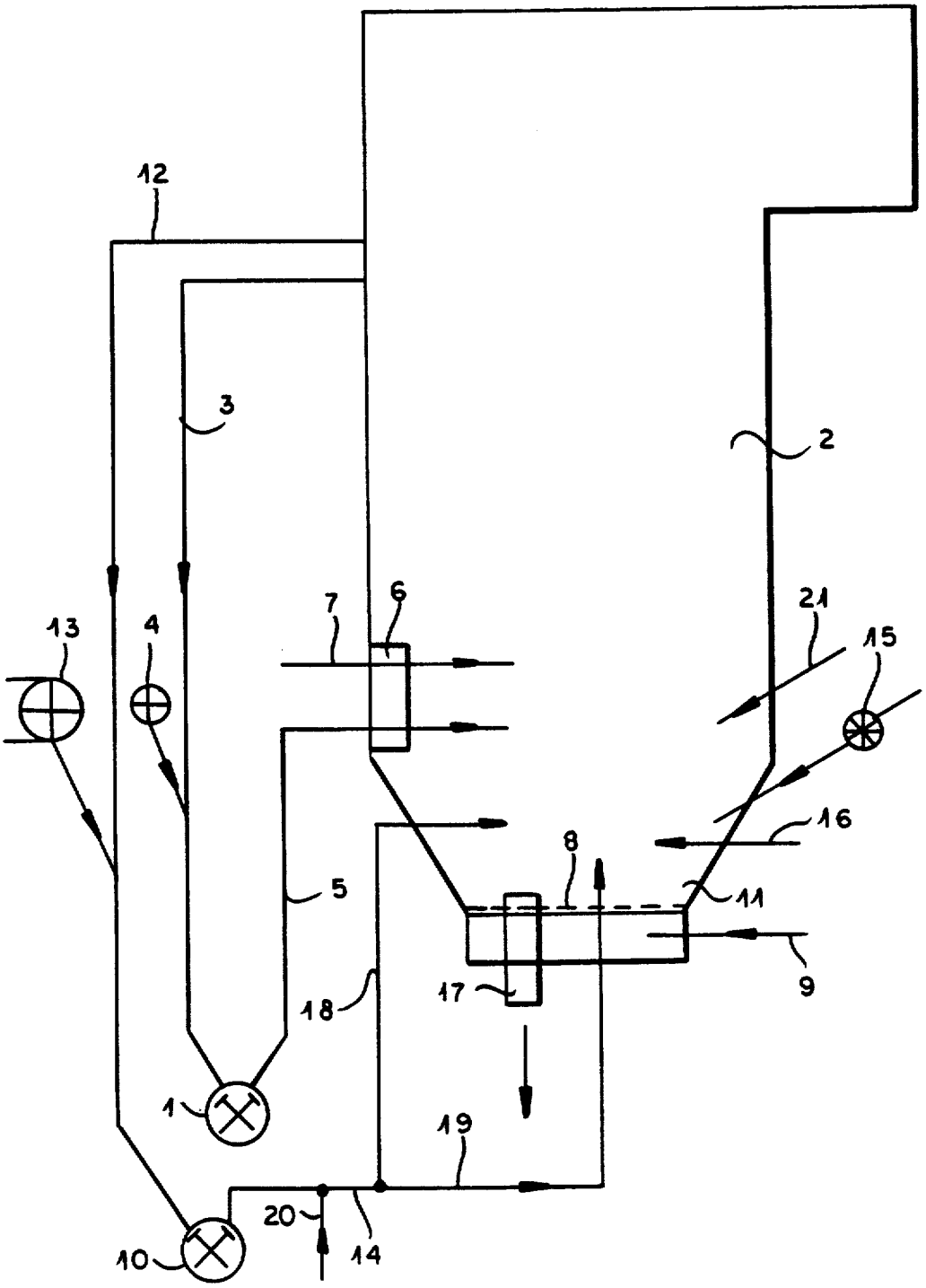
FIG. 1 is a schematic arrangement of a stationary combustion system according to the invention.
Figure 2:
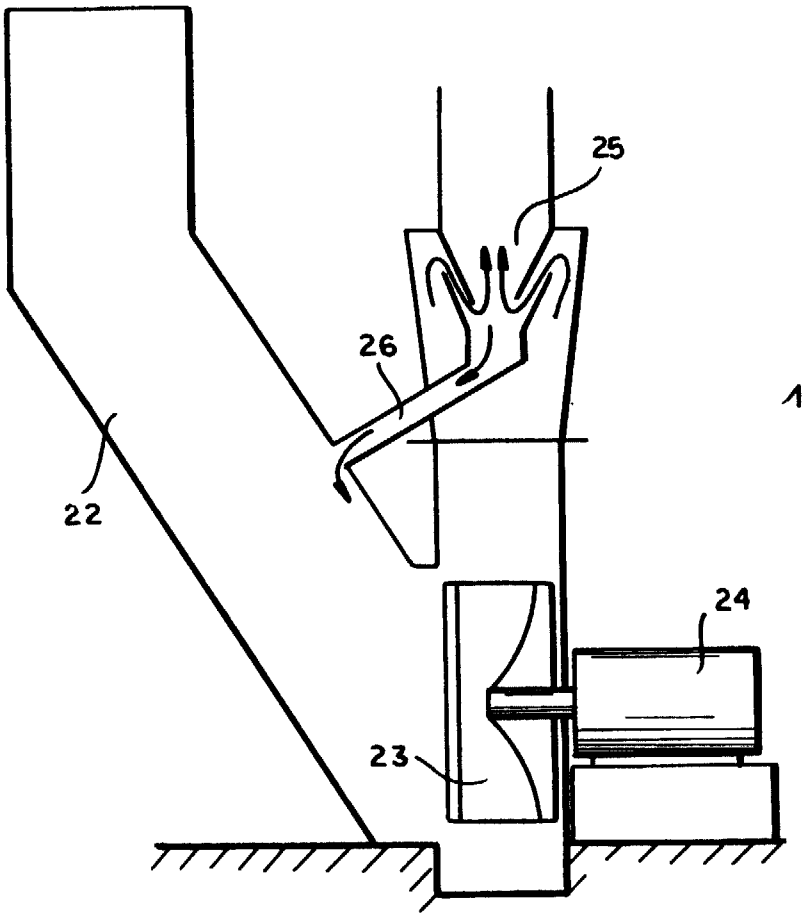
FIG. 2 is a section of a coal mill with an air separator.

The combustion plant shown by way of example in FIG. 1 contains a boiler from the combustion chamber 2 of which a coal mill 1 sucks hot exhaust gas via a duct 3 for drying and transporting the coal supplied by way of a coal feeder 4. The coal mill 1 grinds the coal to the fineness required for pulverized coal combustion and for this purpose it is equipped with an air separator 25 which is illustrated in FIG. 2. The air separator 25 separates the coal particles not ground to the required fineness from the pulverized coal-containing air stream and the separated part is recycled to the repeated grinding process in the coal mill 1.

The coal mill 1 provided with the air separator 25 is shown in greater detail in FIG. 2. As will be obvious from the sectional view, the mixture of air and flue gas and the raw coal are fed via a duct 22 into the coal mill. The coal mill 1 itself has a beater head 23 and a drive motor 24. The air separator 25 is disposed above the beater head 24 and its lower part is connected via a duct 26 with the duct 22 for recycling the coarse coal grindings separated in the air classifier into the coal mill.

The pulverized coal conveyed to the pulverized coal burners may also originate from a pulverized coal source operated independently from the boiler and without the intermediation of the coal mill 1. The mixture consisting of the pulverized coal and gas is delivered from the coal mill 1 via a duct 5 to at least one pulverized coal burner 6. The pulverized coal burner 6 may be arranged as desired, e.g. in the form of a ceiling burner, a side burner or a corner burner. Air is also conveyed to the pulverized coal burner 6 via a duct 7.

Figure 4A:
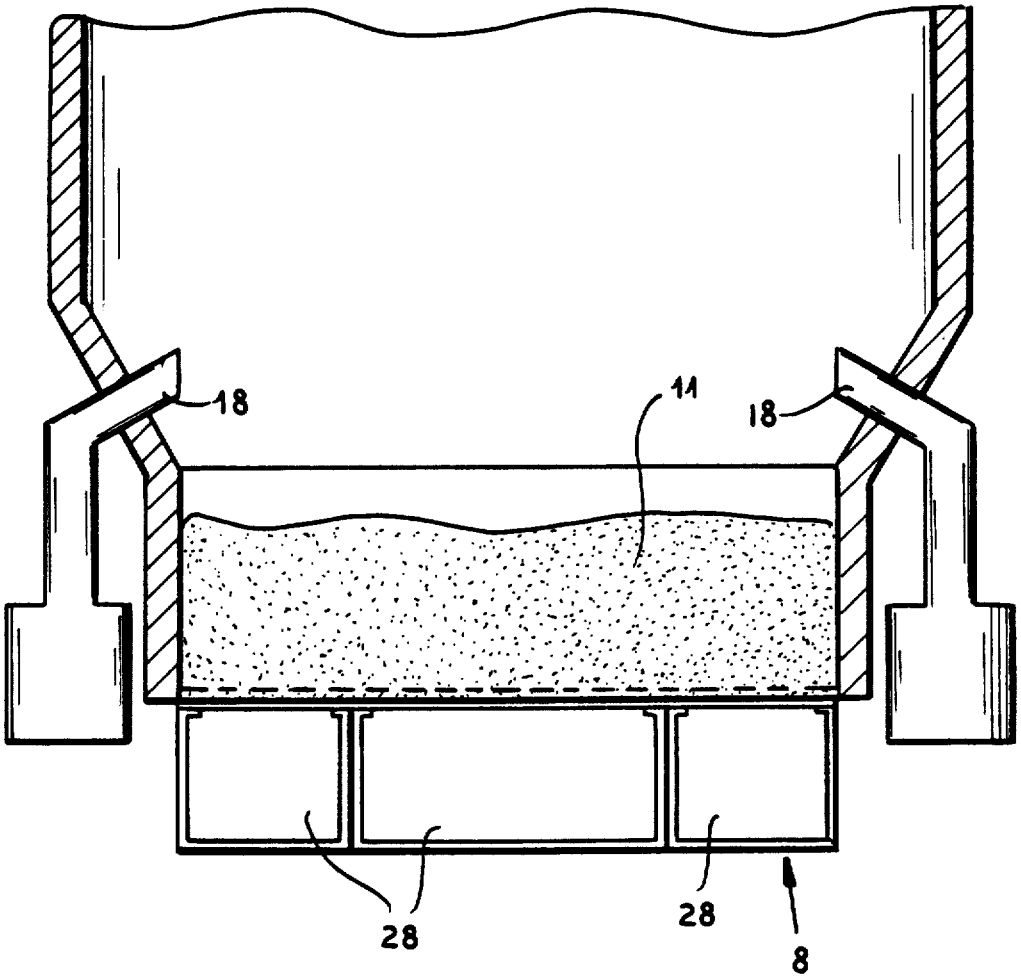
FIGS. 4*a* and 4*b* are two sections from different views of the air separator of the fluidized bed combustion portion.
Figure 4B:
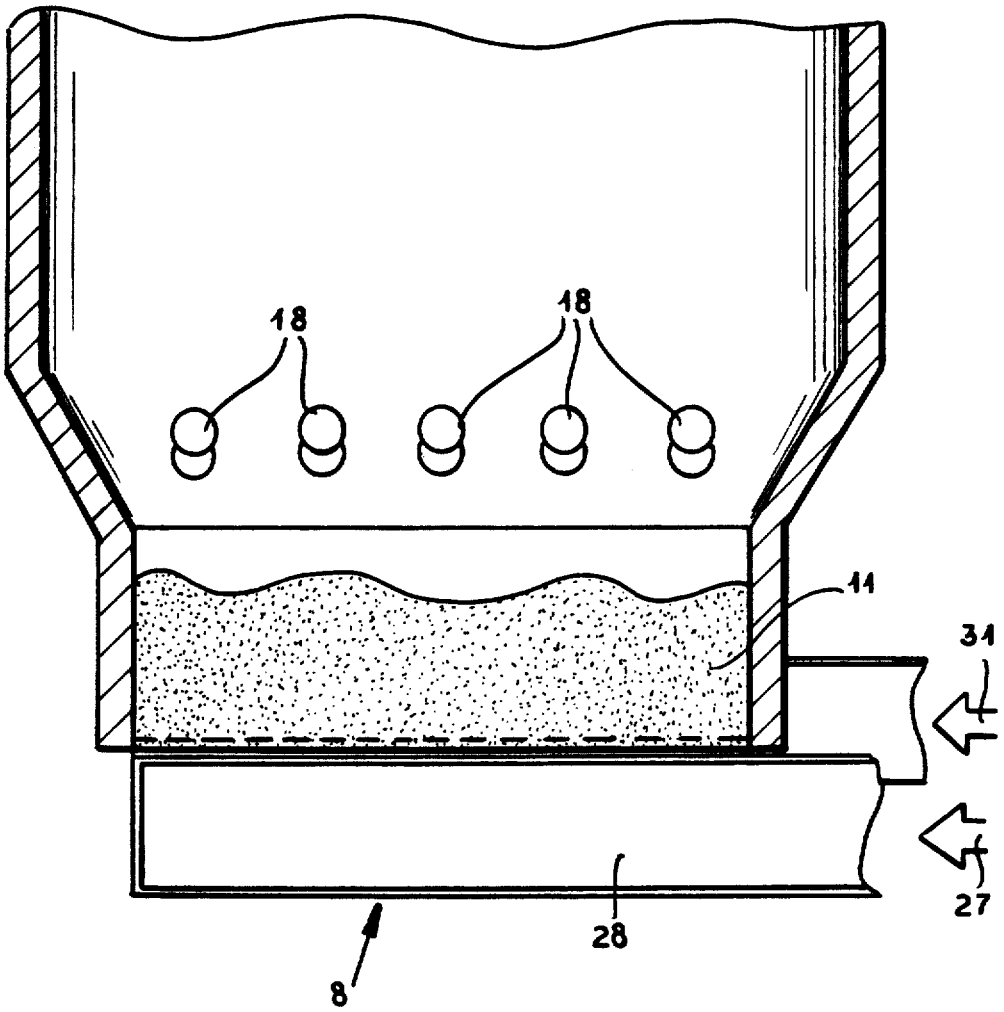

An air distributor 8 for the fluidized bed combustion is arranged in the lower part of the combustion chamber 2 and the fluidization air is passed via a duct 9 beneath the air distributor 8. It is advantageous to divide the air distributor into sectors which enable a sectoral regulation of the velocity of the fluidization air, whereby a favourable flue gas flow distribution may be achieved in the combustion chamber 2. The air distributor 8 arranged beneath the fluidized bed 11 is shown in section in FIGS. 4*a* and 4*b*. The sectors 28 of the air distributor 8 are particularly well visible in FIG. 4*a*.

Figure 3:
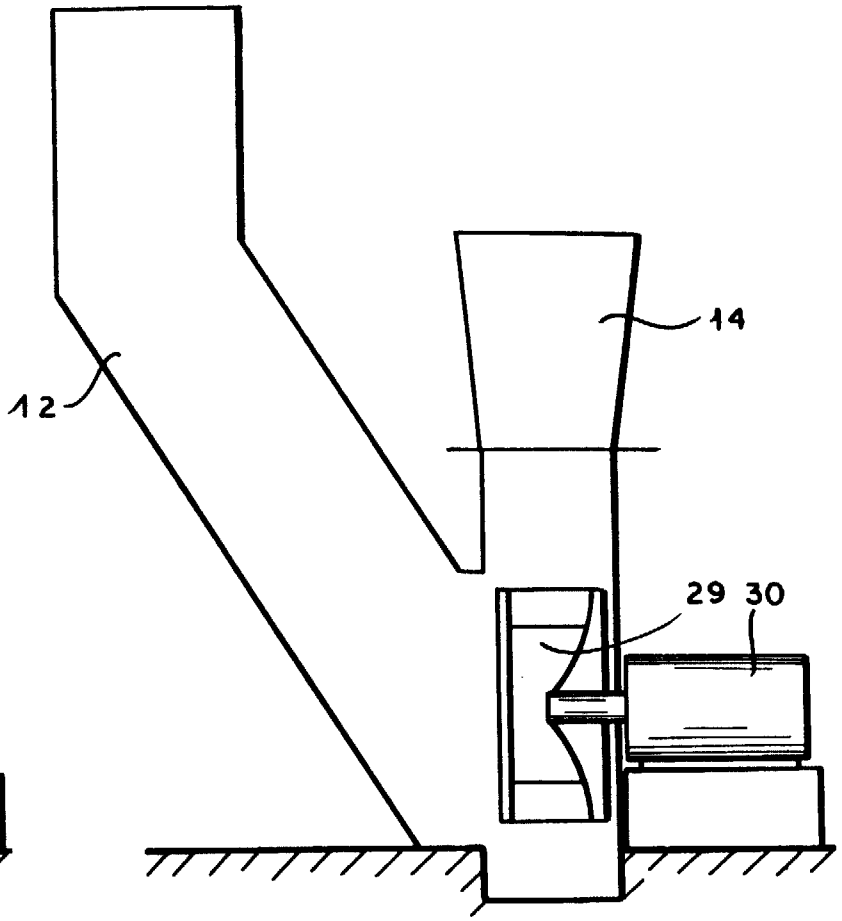
FIG. 3 is a section of a coal mill without an air separator.

The coal is charged in above the fluidized bed 11 through a duct 18 or, in the case of feeding from below, via the air distributor 8 by a way of duct 19 from a coal mill 10 or from a coal crusher. The coal mill 10 or the coal crusher comminutes coal to the usual particle size for fluidized bed combustion so that here the coarse particles need not be separated and recycled to the coal mill and correspondingly also no air separator is built in. The coal mill 10 is shown schematically in FIG. 3. As is evident from this illustration, the coal mill 10 has a beater head 29, a drive motor 30 as well as a duct 14 for the discharge of the coarse ground material and the air-flue gas mixture.

The coal mill 10 also sucks flue gas from the combustion chamber 2 via a duct 12 into which the unground coal is introduced with the aid of a coal feeder 13. As already mentioned, the pulverized coal-gas mixture may be passed downstream of the coal mill 10 from the duct 14 either via the duct 18 over the fluidized bed 11 into the combustion chamber 2 or in the case of feeding the fluidized bed 11 from below via a duct 19 through the air distributor 8 to beneath the fluidized bed 11. The air supply takes place via the duct 31 or the duct 27, as may be seen from FIG. *4b*.

Figure 5:
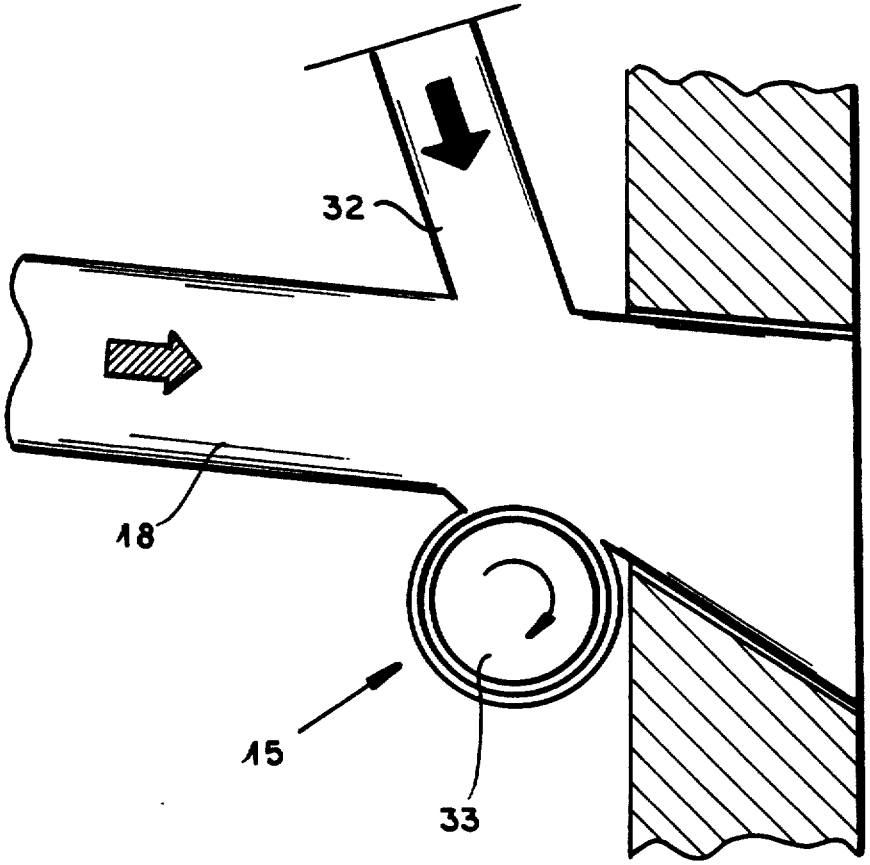
FIG. 5 is a section of a spray feeder.

In another preferred embodiment the charging of the fluidized bed 11 takes place with the aid of a spray feeder 15, whereby the coal of suitable particle size is sprayed over the fluidized bed 11. The schematic construction of the spray feeder 15 is shown in FIG. 5. The unbroken raw coal arrives via a duct 32 to a rapidly rotating disc 33 which sprays the coal onto the fluidized bed 11. The duct 18 which feeds the coarse ground goods from the coal mill 10 without an air separator to the fluidized bed 11 is in general not in operation when the spray feeder 15 is in operation, while in contrast, when it is operated, then in general the spray feeder 15 is inoperational.

In all these embodiments the air is fed via the duct 16 in such a quantity that together with the air supply via the duct 7 as is required for a full combustion of the gas-exhaust gas mixture flowing out from the fluidized bed combustion chamber and of the pulverized coal fed over the duct 5 is required; the oxygen content of the gas-exhaust gas mixture leaving the fluidized bed 11 is adjusted to the usual value (2–10%). The temperature of the fluidized bed is regulated by regulating the amount of fluidizing air.

The additive for binding the contaminating $SO_2$ is fed from the duct 20 and/or the duct 21.

The solid incombustible material remaining after combustion is removed from the combustion chamber 2 by way of the slag removal duct 17 passed through the air distributor 8.

When it is the intention to operate the fluidized bed combustion part of the hybrid combustion system separately, i.e. without operating the part serving for pulverized coal combustion, the coal feeder and the coal mill 1 are at a standstill, no pulverized coal is blown in via the duct 5, while the coal feeder 13, the coal mill 10 and/or the spray charger 15 feed the part serving for fluidized bed combustion. When, however, the intention is to keep the part serving for pulverized coal combustion in operation, and moreover without setting the part for fluidizing bed combustion into operation, then the coal mill 1 and the duct 5 for blowing in the pulverized coal are activated, while the feeder 13, the coal mill 10 and/or the spray feeder 15 as well as the duct 9 for blowing in the air are put out of operation.

As will unambiguously be clear from the description of the above embodiment, the plant according to the invention enables the combination of pulverized coal combustion and the fluidized bed combustion while simultaneously eliminates the drawbacks of these combustion methods.

An important advantage of the plant according to the invention consists in that it can assure a stable combustion even with a low-value or poor coal quality and even at a partial load of 30 to 40%, while the quantity of heat released in the combustion chamber is not restricted at all by the air distributor, and advantages regarding environmental protection may also be achieved.

These advantages are provided also when converting existing pulverized coal boilers or furnaces to the hybrid combustion system according to the invention. The conversion of boilers built originally for pulverized coal combustion to hybrid combustion may ensue by removing the air separator from one part of the already existing coal mills serving for the production of fine pulverized coal, whereby the coal mill 1 is converted to coal mill 10 without air separator. Instead of the lower funnel of the boiler, the fluidized bed is fed with coarse ground products of these converted coal mills 10. An air distributor serving to supply air to the fluidized bed is arranged beneath the fluidized bed. The other coal mills of the boiler serving for the production of fine coal dust as well as the coal dust burners may remain unaltered.

Such a boiler conversion is particularly advantageous when the quality of the coal combusted in the boiler changes, becomes worse and the boiler dimensioned for combusting a better coal can no longer be maintained at a stable operation with the originaly built-in pulverized coal combustion system. After the conversion, stable operation is assured by the fluidized bed combustion even for poorer coal quality, and consequently the main components of the boiler need not be modified or replaced.

What is claimed is:

1. A hybrid combustion system comprising: a portion for fluidized bed combustion comprising:

a fluidized bed chamber;

a coal mill without air separator;

a recycling duct connected to said coal mill serving for recycling a flue gas;

a coal supply duct for supplying coal;

a spray feeder and at least one air supply duct for fluidization and combustion; and a portion for pulverized coal combustion comprising:

a pulverizing coal mill with air separator;

a blowing duct for blowing in coal ground in said pulverizing coal mill;

at least one pulverized coal burner;

a recycling duct connected to said pulverizing coal mill serving for recycling a flue gas; and wherein said fluidized bed combustion takes place in a lower part of said system and pulverized coal combustion takes place above said fluidized bed combustion, each of said portions being independent in operation of the other, and a main combustion chamber being provided so as to be common to said fluidized bed portion and to said portion for pulverized coal combustion for burning rising fuel and said pulverized coal.

2. A hybrid combustion system according to claim 1, wherein said portion for fluidized bed combustion and said pulverized coal combustion are each independently operable without operating said respective other portion.

3. A hybrid combustion system according to claim 1, wherein said fluidized bed chamber is supplied with coal comminuted according to need in said coal mill without air separator and dried by means of exhaust gas sucked in from said combustion chamber through said recycling duct as necessary and its temperature is regulated by the amount of fluidizing air fed through said air supply duct.

4. A hybrid combustion according to claim 3, further comprising an air distributor for sectoral regulation of air supply, said air distributor being arranged beneath said fluidized bed and formed as a magazine.

5. A hybrid combustion system according to claim 1, wherein coal supplied to said fluidized bed portion differs in quality from that supplied to said pulverized coal portion.

6. A hybrid combustion system according to claim 1, wherein said pulverized coal portion has a combustion capacity exceeding that of said fluidized bed portion.

7. A hybrid combustion system according to claim 1, wherein combustion air in said fluidized bed portion has a flow velocity higher than 4 m/s while an air-coal dust mixture blown in for pulverized coal combustion has a velocity between 12–25 m/s.

8. A hybrid combustion system according to claim 1, wherein said fluidized bed chamber has a width less than a width of said main combustion chamber.

9. A hybrid combustion process, comprising the steps of:

(a) pulverizing coal in a first coal mill having an air separator, separating coarse coal particles from the pulverized coal, recycling separated coal particles to said coal mill, entraining said pulverized coal in hot exhaust gas drawn from a main combustion chamber, introducing the pulverized coal entrained in said hot exhaust gas and oxygen into said chamber, and combusting the pulverized coal entrained in said hot exhaust gas at a burner opening into said main combustion chamber at a location above a bottom thereof;

(b) milling coal in a second coal mill without an air separator to produce milled coal, entraining said milled coal in hot exhaust gas from said main combustion chamber, introducing said milled coal entrained in hot exhaust gas into said main combustion chamber above said bottom and below said location, introducing a fluidizing gas through said bottom into said combustion chamber to form a fluidized bed of said milled coal in said chamber above said bottom, and introducing oxygen into said chamber below said location for combustion of said milled coal in said fluidized bed; and (c) selectively controlling the combustion so that steps (a) and (b) are selectively effected simultaneously and alternatively.

* * * * *